United States Patent [19]

Kusz

[11] Patent Number: 4,524,876

[45] Date of Patent: Jun. 25, 1985

[54] TAMPER INDICATING CHILD-RESISTANT PACKAGE

[75] Inventor: Maximillian Kusz, Waterville, Ohio

[73] Assignee: Owens-Illinois, Inc., Toledo, Ohio

[21] Appl. No.: 643,590

[22] Filed: Aug. 23, 1984

[51] Int. Cl.[3] ..... B65D 55/02

[52] U.S. Cl. ..... 215/224; 215/223; 215/253; 215/258

[58] Field of Search ..... 215/223, 224, 252, 253, 215/258

[56] References Cited

U.S. PATENT DOCUMENTS

| | | | |
|---|---|---|---|
| 4,071,156 | 1/1978 | Lowe | 215/224 |
| 4,375,859 | 3/1983 | Fillmore | 215/223 |
| 4,449,639 | 5/1984 | Davis | 215/224 |
| 4,457,437 | 7/1984 | Heath, Jr. | 215/224 |

*Primary Examiner*—George T. Hall

*Attorney, Agent, or Firm*—John R. Nelson

[57] ABSTRACT

A tamper indicating child-resistant package comprising a container having a body and a neck, said neck having at least one retaining bead with a notch therein and a closure comprising a base wall and a peripheral wall having at least one pair of locking lugs generally diametrically opposite to one another such that the closure can be rotated to orient one of the locking lugs with a notch permitting the closure to be removed by an upward force in the area of the notch to produce a tipping movement. The peripheral wall of the closure has an axially extending band connected to the lower end of the peripheral wall by a weakened line and the band has an inner regular polygonal surface. The container has a portion at the area of juncture of the neck and body with an external polygonal configuration complementary to the polygonal configuration on the interior of the band such that the closure can be applied with the lug in unoriented position to the notch by an axial movement with the lug snapping over the retaining bead, bringing the polygonal configuration of the band into engagement with the polygonal configuration of the shoulder on the container such that the closure cannot be removed without breaking the weakened line.

12 Claims, 4 Drawing Figures

TAMPER INDICATING CHILD-RESISTANT PACKAGE

This invention relates to child-resistant packages and, particularly, to tamper indicating child-resistant packages.

BACKGROUND AND SUMMARY OF THE INVENTION

Safety legislation now requires that closures for certain kinds of products be of the child-resistant type. In one type of child-resistant package the closure is of the snap-on type which includes interengaging lugs on the closure and one or more retaining beads on the container wherein the lug must be aligned with a notch in a retaining bead by rotating the container to bring the notch into alignment so that the closure can be forced upwardly and removed by a tipping movement. In order to make such a package tamper indicating, it has been common to shrink a film over the closure.

Among the objectives of the present invention are to provide a novel tamper indicating child-resistant package which utilizes a closure of the snap-on type.

In accordance with the invention, the tamper indicating child-resistant package comprises a container having a body and a neck, said neck having at least one retaining bead with a notch therein and a closure comprising a base wall and a peripheral wall having at least one pair of locking lugs generally diametrically opposite to one another such that the closure can be rotated to orient one of the locking lugs with a notch permitting the closure to be removed by an upward force in the area of the notch to produce a tipping movement. The peripheral wall of the closure has an axially extending band connected to the lower end of the peripheral wall by a weakened line. The band has an inner regular polygonal surface. The container has a portion at the area of juncture of the neck and body with an external polygonal configuration complementary to the polygonal configuration on the interior of the band such that the closure can be applied with the lug in unoriented position to the notch by an axial movement with the lug snapping over the retaining bead, bringing the polygonal configuration of the band into engagement with the polygonal configuration of the shoulder on the container such that the closure cannot be removed without breaking the weakened line.

DESCRIPTION

Referring to FIGS. 1–4, the child-resistant package embodying the invention comprises a closure 20 and a container 21. The closure 20 is preferably made of organic plastic material such as high density polyethylene and the container 21 is preferably made of organic plastic material such as high density polyethylene but also may be made of glass.

Figure 1:
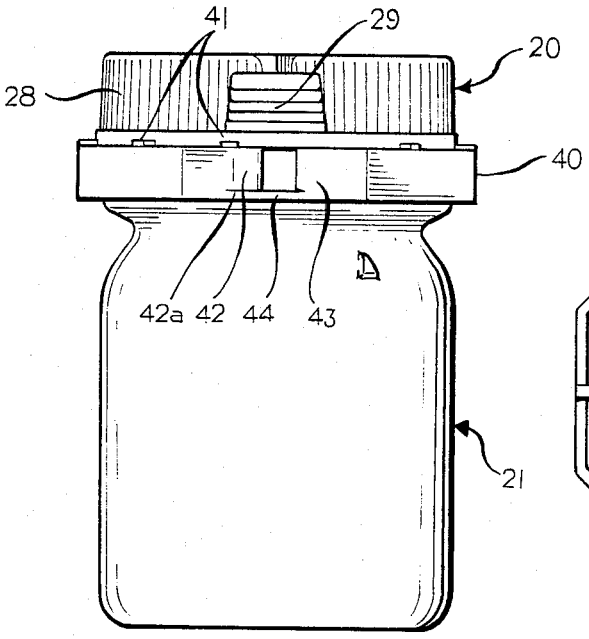
FIG. 1 is an elevational view of a child-resistant package embodying the invention.
Figure 2:
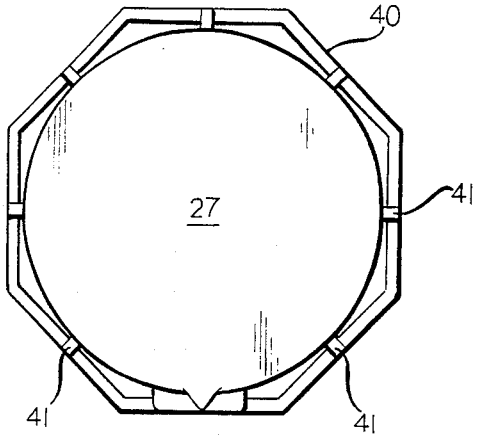
FIG. 2 is a plan view of the closure.
Figure 3:
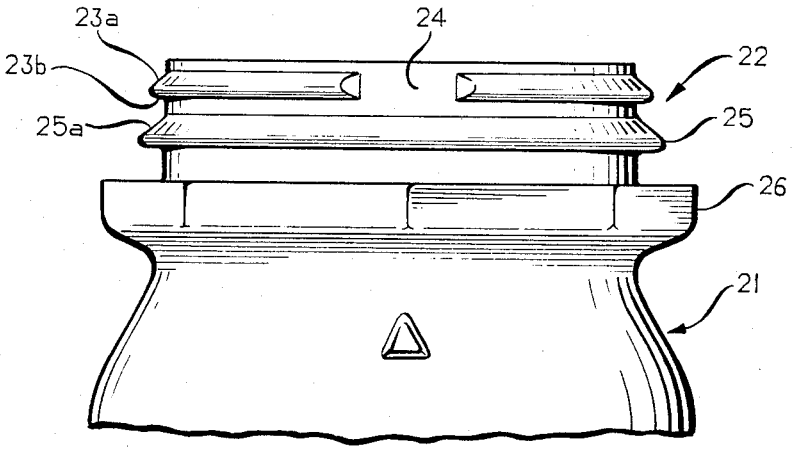
FIG. 3 is a fragmentary elevational view of the container on an enlarged scale.
Figure 4:
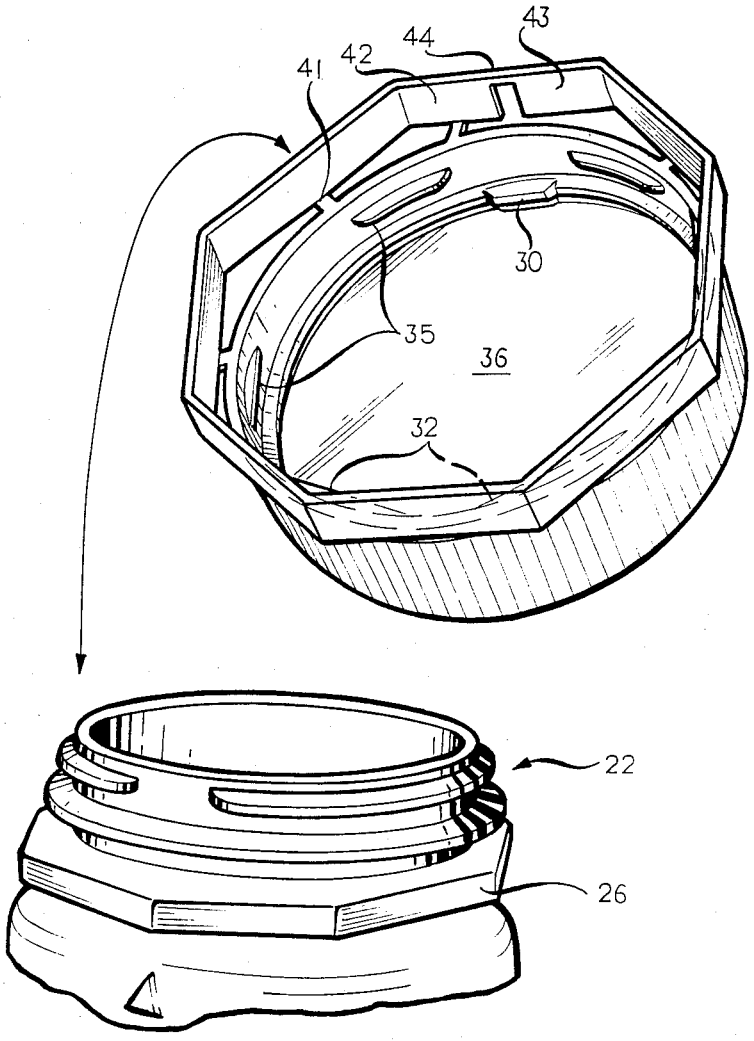
FIG. 4 is a partly diagrammatic view of the package.

In accordance with the invention, the container 21 has a neck finish 22 formed with a first or upper annular retaining bead 23 having a notch 24 in its periphery and a second or lower continuous annular bead 25 (FIGS. 2–4). The container is further formed with a protective flange 26 extending radially outwardly from and axially spaced below the second retaining bead 25 and an indicia 21*a* on the neck aligned with notch 24. The outer diameter of the upper retaining bead 23 is less than the diameter of the lower retaining bead 25. Each bead 23, 25 has inclined upper surfaces 23*a*, 25*a* to facilitate snap action assembly. The upper bead 23 has a lower generally horizontal or radial surface 23*b* to facilitate locking.

The closure 20 includes a flat top or panel portion 27 and a peripheral skirt portion 28. An external lifting tab 29 is provided on the outer surface of the skirt 28 and a first radially inwardly extending locking lug 30 having an arcuate extent substantially equal to or less than the arcuate extent of the notch 24 is provided on the inner surface of the skirt 28 adjacent the lifting tab 29. The first lug 30 is provided axially on the skirt in a position such that it extends beneath the first retaining bead 23 when the closure is in position on the container and preferably does not contact bead 23.

The skirt 28 is further formed with at least one radially inwardly extending locking lug 32 generally diametrically opposite to first locking lug 30. Lug 32 is axially positioned along the skirt near the lower edge so that it will engage below the second retaining bead 25 when the closure is on the finish. Preferably, a plurality of lugs 32 are provided, shown as a pair of lugs, and each having a greater arcuate extent than lug 30.

The skirt is further formed with at least one integral arcuate stabilizing bead 34 opposite the longer lugs 32, and below the first locking lug which is adapted to engage beneath the second retaining bead 25 and stabilize the rotation of the closure so that it will rotate evenly.

The diametral distance between the stabilizing bead 34 and the second locking lugs 32 is greater than the diameter of the upper or first retaining bead 23 on the finish of the container. The stabilizing bead 34 maintains contact with the second retaining bead 25 even when the first locking lug 30 is oriented into register with the notch 24, thereby preventing upward movement of the closure 20. Thus, the stabilizing bead 34 cooperating with the lower retaining bead 25 functions to prevent any axial motion that might suggest to a child that the closure is in a position for removal.

As a result of the construction, there is a substantial clearance between the inner surface of the skirt 28 of the closure 20 and the upper retaining bead 23 and a snug circumferential contact between the inner surface of the skirt 28 and the lower retaining bead 25.

In order to permit less stringent manufacturing tolerances, the closure includes a plurality of tangential flat-faced facets 35 in the skirt of the closure adapted to frictionally engage the lower retaining bead 25 and thereby provide maximum closure retention over the tolerances of the closure and finish. The facets 35 thus prevent lateral or radial movement of the closure relative to the finish so that the engagement with the lower retaining bead 25 is maintained even though there are variations in the dimensions of the closure and finish in the manufacture thereof.

In order to provide moisture vapor transmission resistance to the package, a liner 36 of expanded plastic material is preferably positioned in the top of the closure between the top wall 27 and the upper end of the finish.

The closure 20 can be applied to the finish in any oriented position of the closure relative to the finish merely by snapping the closure onto the finish. By having the diameter of the upper retaining bead 23 smaller than the diameter of the lower retaining bead 25, and the diametral distance between the lower locking lugs 32 and the stabilizing segment 34 being greater than the diameter of the upper retaining bead 23, the lower retaining bead 25 and stabilizing segment 34 are prevented from engaging the upper bead 23 thereby preventing inadvertent unlocked attachment when the closure is partially applied.

When it is desired to remove the closure, it is rotated bringing the external tab 29 into registry with indicia A on the exterior of the container and then an upward force is applied to the tab 29 permitting the lug 30 to be moved freely through the notch 24 and the closure to be removed by a tipping movement.

The use of upper and lower retaining beads 23, 25 on the finish with two lugs 30 and 32 on the closure at different axial or elevational positions within the closure combined with the stabilizing segment 34 causes the closure to rotate evenly without noticeable elevation of the closure when the closure is placed in the opening position as when the closure is brought into registry with the indicia inadvertently, for example by a child. This is especially effective when a liner is used since the liner tends to lift the closure firmly against the retaining beads.

The use of two retaining beads on the finish, one of which has a notch, causes the closure to rotate smoothly even though the finish may be distorted due to tolerances. The use of the facets 35 within the closure insures that the closure is prevented from moving laterally with respect to the finish to thereby provide proper interference fit with the annular lower bead under most variations of tolerances of the closure of finish.

When the closure is on the container, the protective flange 26 extends radially outwardly below the lower edge of skirt 28 of closure 20 and in close proximity thereto to prevent access to the lower edge of the skirt so that the skirt can not be pried away from the closure.

The package above described is shown and described in U.S. Pat. No. 4,375,859 which is incorporated herein by reference.

In accordance with the invention, a tamper indicating band 40 is associated with a closure 20 and comprises an integral band molded with the closure 20 and connected to the wall by a weakened line defining bridges 41. The band 40 is preferably of uniformly thick cross section and defines an internal regular polygonal configuration of at least three surfaces, and preferably more, eight being shown. Further in accordance with the invention, the shoulder 26 of the container has an external polygonal configuration complementary to the configuration of the band 40.

Band 40 has one polygonal side partly severed on an axial line to form tabs 42, 43 connected by a thin circumferential portion 44. Tab 42 extends radially inwardly toward tab 43 and includes a free end defined by a slot 42*a*. Notch 24 on the finish is located circumferentially at the intersection of two sides of polygonal shoulder 26 and lug 30 on the closure is circumferentially aligned with the midpoint of a flat side of the polygonal band 40 of the closure. Alternatively, notch 40 can be located at the midpoint of a side of the polygonal shoulder 26 and lug 30 can be located circumferentially at the intersection of two sides of the polygonal band 40.

The closure is applied to the container by an axial movement with the locking lug out of alignment with the notch, the lugs snapping over the bead. The polygonal shape of band 40 and shoulder 26 necessitate circumferential alignment for initial application of the closure. Such orientation prevents lug 30 from being aligned with notch 24 in any of the eight possible orientations of the closure because of the relative location of the lug 30 and notch 24 with respect to the polygonal sides.

When it is desired to remove the closure, the band is grasped by tab 42 and broken along the weakened line 44. With continued pulling, the bridges 41 are broken and the tamper indicating band is completely broken away allowing closure 20 to be rotated to bring the indicator A in alignment so that the lug 30 can be pushed upwardly through the notch 24 and the closure can be tipped and removed. Thereafter, the closure can be applied to the container in any circumferential orientation inasmuch as the polygon shaped tamper band 40 is no longer attached to the closure. After removal of the band, the closure and container will still function as a child-resistant package.

It can thus be seen that there has been provided a closure of snap-fit type which has a tamper indicating construction.

Although the invention has been described in connection with snap-on packages of the type set forth in U.S. Pat. No. 4,375,859 utilizing two retaining beads, it can also be applied to other snap-on closures utilizing a single retaining bead and associated notch on a closure having at least one pair of locking lugs.

I claim:

1. A tamper indicating child-resistant package comprising a container having a body and a neck, said neck having at least one retaining bead with a notch therein and a closure comprising a base wall and a peripheral wall, said peripheral wall having at least one pair of locking lugs generally diameterically opposite to one another such that the closure can be rotated to orient one of the locking lugs with the notch on the container permitting the closure to be removed by an upward force in the area of the notch to produce a tipping movement, said peripheral wall of said closure having an axially extending band connected to the lower end of the peripheral wall by a weakened line, said band having an inner regular polygonal surface, said container having a portion at the area of juncture of the neck and body with an external polygonal surfaces complementary to the polygonal configuration on the interior of the band such that the closure must be applied with the lug in unoriented position to the notch by an axial movement with the lug snapping over the retaining bead, bringing the polygonal configuration of the band into engagement with the polygonal configuration of the shoulder on the container such that the closure cannot be rotated without breaking the band along the weakened line.

2. The tamper indicating child-resistant package set forth in claim 1 including a tab on the band for engagement of the band.

3. The tamper indicating child-resistant package set forth in claim 2 wherein said band includes an axial weakened line in the area of the tab such that when the tab is engaged the band will break along the axial line as well as the peripheral weakened line.

4. The tamper indicating child-resistant package set forth in claim 3 wherein said axial weakened line comprises a slot and said peripheral weakened line comprises a thin circumferential connecting band.

5. The tamper indicating child-resistant package set forth in claim 2 wherein said band includes a second tab spaced from said first tab and having a free end extending radially inwardly from said first tab.

6. The tamper indicating child-resistant package set forth in claim 1 wherein one of said locking lug on said closure and said notch on the container is located circumferentially at the intersection of two sides of the polygonal surface of the element on which it is located and the other of said locking lug and said notch is located circumferentially along a side of the polygonal surface of the element on which it is located.

7. A tamper indicating child-resistant package comprising a container having a body and a neck, said neck having at least one retaining bead with a notch therein and a closure comprising a base wall and a peripheral wall, said peripheral wall having at least one pair of locking lugs generally diametrically opposite to one another such that the closure can be rotated to orient one of the locking lugs with a notch on a container permitting the closure to be removed by an upward force in the area of the notch to produce a tipping movement, said peripheral wall of said closure having an axially extending band connected to the lower end of the peripheral wall by a weakened line, said band having an inner regular polygonal surface adapted to be complementary to an external polygonal surface on the container such that the closure must be applied with the lug in unoriented position to a notch on a container by an axial movement with the lug snapping over the retaining bead, bringing the polygonal configuration of the band into engagement with the polygonal configuration of a shoulder on the container such that the closure cannot be rotated without breaking the weakened line.

8. The tamper indicating child-resistant package set forth in claim 7 including a tab on the band for engagement of the band.

9. The tamper indicating child-resistant package set forth in claim 8 wherein said band includes an axial weakened line in the area of the tab such that when the tab is engaged the band will break along the axial line as well as the peripheral weakened line.

10. The tamper indicating child-resistant closure set forth in claim 9 wherein said axial weakened line comprises a slot and said peripheral weakened line comprises a thin circumferential connecting band.

11. The tamper indicating child-resistant closure set forth in claim 10 wherein said band includes a second tab spaced from said first tab and having a free end extending radially inwardly from said first tab.

12. The tamper indicating child-resistant closure set forth in claim 7 wherein one of said locking lug on said closure and said notch on the container is located circumferentially at the intersection of two sides of the polygonal surface of the element on which it is located and the other of said locking lug and said notch is located circumferentially along a side of the polygonal surface of the element on which it is located.

* * * * *